US005242312A

United States Patent [19]

Tondreault

[11] Patent Number: 5,242,312

[45] Date of Patent: Sep. 7, 1993

[54] BOARD TO SOCKET RETAINER CLIP

[75] Inventor: Robert J. Tondreault, Louisville, Ky.

[73] Assignee: Robinson Nugent, Inc., New Albany, Ind.

[21] Appl. No.: 883,208

[22] Filed: May 14, 1992

[51] Int. Cl.[5] ..... H01R 13/00

[52] U.S. Cl. ..... 439/328

[58] Field of Search ..... 439/296, 327-329

[56] References Cited

U.S. PATENT DOCUMENTS

| | | | |
|---|---|---|---|
| 3,216,580 | 11/1965 | Fricker, Jr. | 439/328 |
| 4,579,411 | 4/1986 | Cobaugh et al. . | |
| 4,725,250 | 2/1988 | Kuhn et al. . | |
| 4,781,612 | 11/1988 | Thrush . | |
| 4,938,701 | 7/1990 | Heberling . | |
| 4,973,270 | 11/1990 | Billman et al. . | |
| 4,986,765 | 1/1991 | Korsunsky et al. . | |
| 4,995,825 | 2/1991 | Korsunsky et al. . | |
| 5,013,257 | 5/1991 | Korsunsky et al. . | |
| 5,013,264 | 5/1991 | Tondreault . | |
| 5,064,381 | 11/1991 | Lin . | |
| 5,094,624 | 3/1992 | Bakke et al. . | |
| 5,112,242 | 5/1992 | Choy et al. . | |

*Primary Examiner*—Joseph H. McGlynn
*Attorney, Agent, or Firm*—Barnes & Thornburg

[57] ABSTRACT

A retainer clip is provided for securing a printed circuit board to a socket having an elongated slot for receiving the board therein. The retainer clip includes a retention section for engaging the socket to retain the retainer clip within the socket and a spring section extending upwardly away from the retention section and having an upper distal end. The spring section extends into a plane defined by an edge of the elongated slot. The retainer clip also includes a contoured section formed at the distal end of the spring section. The contoured section is configured to engage an aperture formed in the board to retain the board within the socket.

32 Claims, 2 Drawing Sheets

BOARD TO SOCKET RETAINER CLIP

BACKGROUND AND SUMMARY OF THE INVENTION

The present invention relates to sockets for electrically coupling a daughterboard to a motherboard. More particularly, the present invention relates to an apparatus that increases the retention force on the daughterboard to maintain an electrical connection between the daughterboard and the motherboard under rough or stressful operating conditions.

The size of computers has been reduced in the past several years. Therefore, computers have become more portable and movable. Movement of the computers can cause shock and vibrations which increases the amount of stress placed on electrical components within the computer. This stress can cause movement of the electrical components which can break or interrupt the electrical connection between the electrical components.

Because of the increased portability of computers, electrical components within the computer must be able to withstand an increased amount of shock and vibration. Computers include a main printed circuit board or motherboard. Additional printed circuit boards or daughterboards must be electrically coupled to the motherboard. Illustratively, the daughterboard may be a single In-line Memory Module (SIMM). A socket is configured to receive a daughterboard and acts as an electrical interconnection between the daughterboard and the motherboard to which the socket is mounted. Problems can arise upon dislocation of daughterboards from sockets coupled to the motherboard. Such dislocation may cause intermittent or failed signal path connections between the daughterboard and motherboard.

The present invention is designed to increase the retention force between a daughterboard and a socket coupled to a motherboard to stabilize the daughterboard within the socket. This reduces the likelihood that the daughterboard will "walk out" or dislodge from the socket.

Conventional sockets such as SIMM sockets are well known. Such conventional SIMM sockets include a plurality of electrical contacts which are electrically coupled to the motherboard. The sockets also include a pair of elongated module-receiving slots extending along a longitudinal axis of the socket for receiving a pair of daughterboards therein. The contacts engage conductive portions formed on the daughterboards inserted into the module-receiving slots to electrically couple the daughterboards to the motherboard. In conventional SIMM sockets, the daughterboards are stabilized by stabilizing beams formed integrally with the socket.

Typically, conventional SIMM sockets include an internal stabilizing beam and a pair of external stabilizing beams. In some conventional SIMM sockets, the external stabilizing beams are movable relative to the internal stabilizing beam. See, for example, U.S. Pat. No. 5,013,264. In other instances, a pair of internal stabilizing beams are movable relative to the external stabilizing beams. See, for example, U.S. Pat. No. 4,973,270. The internal and external stabilizing beams provide a frictional force against the daughterboards installed in the SIMM socket. While the retention force of the conventional stabilizing beams may be suitable for stable environments, the retention force may be insufficient if the SIMM socket is used in a stressful environment and subjected to shock and vibration.

It is also known to provide a metal latch to retain a daughterboard in a SIMM socket. Such metal latches typically hold an aperture formed in the daughterboard in a predetermined position over a locator pin or stop member integrally formed on the socket housing. A user must typically manually displace the latch in order to release the daughterboard from the socket. See, for example, U.S. Pat. No. 4,986,765; U.S. Pat. No. 4,995,825; U.S. Pat. No. 5,013,257; U.S. Pat. No. 5,064,381; and U.S. Pat. No. 5,094,624. Other conventional connectors are formed to include integral latch arms which engage holes formed in a substrate. See, for example, U.S. Pat. No. 4,725,250 and U.S. Pat. No. 4,781,612. It is often undesirable to require a user to manually displace a latch in order to remove the daughterboard. Several SIMM sockets are often arranged very close together on a motherboard. Therefore, it is often difficult to access a latch to release the daughterboards.

The present invention is designed to provide an increased retention force between the socket and the daughterboard. Advantageously, however, the present invention does not require the user to displace the retaining means manually in order to remove the daughterboard from the socket. Therefore, the present invention advantageously provides a socket having an improved retention force compared to conventional sockets having internal and external stabilizing beams without the disadvantages of the conventional metal latches. The present invention includes an additional retainer clip located at first and second ends of each daughterboard adjacent internal and external stabilizing beams to increase the retention force of the sockets.

The retainer clip of the present invention is configured to be hidden from the user. As discussed above, the retainer clip functions to retain the daughterboard within the socket without any direct displacement by the user during insertion or retraction of the daughterboard.

The retainer clip of the present invention is configured to be loaded into the socket from a bottom surface of the socket. Therefore, the retainer clip is not exposed at the entry location of the daughterboard into the socket. This prevents possible destruction or dislocation of the retainer clip when the daughterboard is inserted into the socket. The retainer clip includes barbs for retaining the retainer clip within the socket. Therefore, the retainer clip is not pushed outwardly from the socket upon insertion of the daughterboard into the socket.

The retainer clip includes a head portion having contoured portion configured to engage a hole or aperture formed in the daughterboard. The shape of the contoured portion of the retainer clip is configured so that top and bottom surfaces of the contoured portion engage an edge of an internal side wall of the daughterboard which defines the aperture in the daughterboard. The bottom surface of the contoured portion has a steep enough angle to provide a positive vertical locking force on the daughterboard while permitting the daughterboard to be removed from the socket when enough force is exerted on the daughterboard. This eliminates the requirement for a user to physically displace or disengage the retainer clip manually. The bottom surface of the contoured portion of the retainer clip is also configured so that the locking angle provided by the retainer clip remains constant regardless how far the contoured portion engages the aperture formed in the daughterboard.

The top surface of the contoured portion provides a lateral force on the daughterboard in a direction normal to the daughterboard and substantially parallel to the motherboard. This lateral force increases the force on a stabilizing beam formed integrally with the socket. Therefore, the retainer clip also increases the frictional retention force of conventional stabilizing beams. The retainer clip secures the daughterboard to the socket to reduce the effects of mechanical shock or vibration on the daughterboard. This increases the reliability of the socket for electrically connecting the daughterboard to the motherboard.

A side surface of the contoured portion of the retainer clip is configured to permit the daughterboard to be removed easily from the socket as the daughterboard is rotated out of the socket. The internal side wall defining the aperture in the daughterboard engages a gently curved ramp surface as the daughterboard is removed. This causes displacement of the retainer clip from the aperture to permit removal of the daughterboard from the socket.

The present invention advantageously increases both the vertical retention force and the horizontal retention force of the daughterboard within the socket. The present invention also permits the daughterboard to be removed from the socket easily without damaging the daughterboard.

According to one aspect of the present invention, a retainer clip is provided for securing a printed circuit board to a socket having an elongated slot for receiving the board therein. The retainer clip includes a retention section for engaging the socket to retain the retainer clip within the socket and a spring section extending upwardly away from the retention section and having an upper distal end. The spring section extends into a plane defined by an edge of the elongated slot. The retainer clip also includes a contoured section formed at the distal end of the spring section. The contoured section is configured to engage an aperture formed in the board to retain the board within the socket.

According to another aspect of the present invention, the contoured section includes a top surface for applying a force against the board in a direction normal to the board and a bottom surface for applying a force against the board in a direction downwardly into said elongated slot. The contoured section further includes a side surface for engaging the board. The side surface provides a ramp for moving the distal end of the spring section relative to the board to disengage the contoured section from the aperture of the board to permit removal of the board from the socket.

A pair of opposing barbs are coupled to the retention section of the retainer clip to secure the retainer clip within the socket. A generally U-shaped base located between the retention section and the spring section. The retainer clip is inserted into the socket from a bottom surface of the socket. The socket is formed to include a generally T-shaped slot for receiving the retention section of the retainer clip therein to secure the retainer clip to the socket. Preferably, the contoured section is formed eccentrically with the distal end of the spring section.

According to yet another aspect of the present invention, a connector is provided for electrically coupling a printed circuit board formed to include an aperture therein to the connector. The connector includes a socket having an elongated slot for receiving the board therein and a plurality of longitudinally spaced electrical contacts configured to be coupled to the board located adjacent the elongated slot. The connector also includes means for stabilizing the board in the socket, and means for retaining the board within the socket. The retaining means including means for engaging the socket to hold the retaining means within the socket and means for engaging the board to increase the retention force on the board within the socket.

The stabilizing means includes an internal stabilizing beam formed on an end for the socket on a first side of the elongated slot and an external stabilizing beam formed on the end of the socket on a second and opposite side of the elongated slot. The internal stabilizing beam includes a contact surface for engaging a first side of the board, and the external stabilizing beam includes a contact surface for engaging a second and opposite side of the board to stabilize the board relative to the socket.

The retaining means increases a frictional force applied by the stabilizing means to the board. In addition, the retaining means applies a downwardly-directed vertical force on the board to secure the board to the socket.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
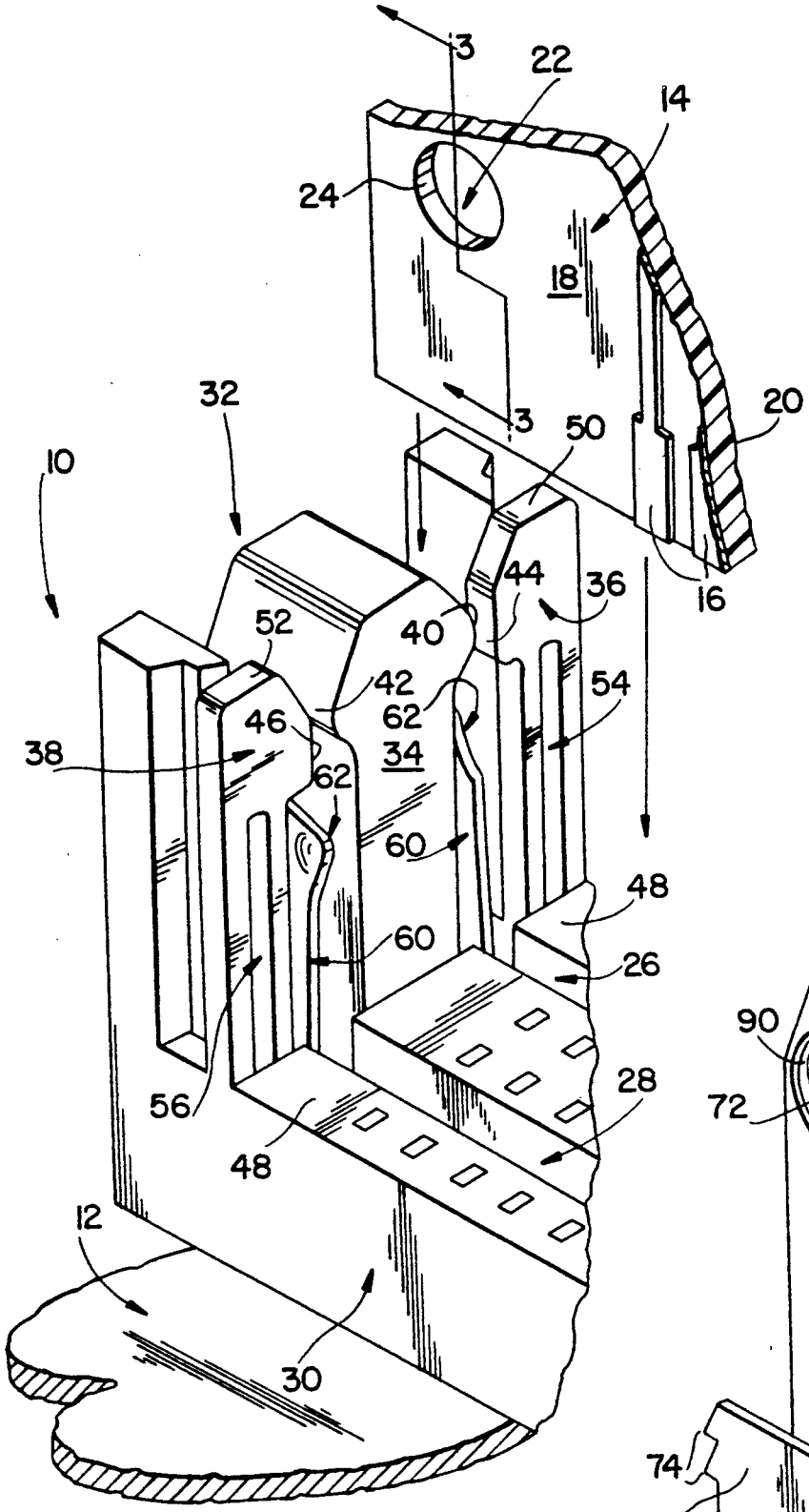
FIG. 1 is a perspective view of an end portion of a SIMM socket for coupling a daughterboard to a motherboard illustrating a retainer clip of the present invention mounted adjacent each elongated slot formed in the socket for securing the daughterboard to the socket.

Referring now to the drawings, FIG. 1 illustrates a conventional SIMM socket 10 for electrically connecting a motherboard 12 to a daughterboard 14. Daughterboard 14 includes a plurality of conductive leads 16 which provide an electrical connection to modules located on daughterboard 14. Conductive leads 16 are formed on both side surfaces 18 and 20 of daughterboard 14. Illustratively, daughterboard 14 is a single in-line memory module (SIMM). Daughterboard 14 is formed to include an aperture 22 at each end of daughterboard 14. Aperture 22 is defined by an interior side wall 24.

SIMM socket 10 is formed to include first and second elongated module-receiving slots 26 and 28. Each of the elongated slots 26 and 28 is configured to receive a daughterboard 14 therein. A plurality of electrical contacts are located within the housing 30 of socket 10. The contacts enter the first and second slots 26 and 28 for engaging the conductive leads 16 on opposite sides 18 and 20 of daughterboard 14 when the daughterboard 14 is inserted into one of the elongated slots 26 or 28. The contacts are also coupled to conductive leads on motherboard 12 to provide an electrical connection between daughterboard 14 and motherboard 12. Such connections are well known in the art. See, for example, U.S. Pat. No. 5,013,264 or U.S. patent application Ser. No. 07/759,409, both of which are assigned to the assignee of the present invention.

SIMM socket 10 includes an end portion 32 which is formed to include an internal stabilizing beam 34 and two external stabilizing beams 36 and 38. Internal stabilizing beam 34 includes a first contact surface 40 and a second contact surface 42. External stabilizing beam 36 includes a contact surface 44, and external stabilizing beam 38 includes a contact surface 46. Internal stabilizing beam 34 is generally rigid and non-movable. External stabilizing beams 36 and 38 provide cantilever spring beams extending upwardly away from a top surface 48 of housing 30. In other words, a free end 50 of external stabilizing beam 36 moves away from the position shown in FIG. 1 upon insertion of a daughterboard into elongated slot 26. A free end 52 of external stabilizing beam 38 moves upon insertion of a daughterboard into elongated slot 28.

An internal slot 54 formed in stabilizing beam 36 permits additional flexibility of stabilizing beam 36. An internal slot 56 which permits increased flexibility of stabilizing beam 38. Forces exerted by contact surfaces 40 and 42 of internal stabilizing beam 34 and contact surfaces 44 and 46 of external stabilizing beams 36 and 38 are generally normal to opposite sides of 18 and 20, respectively, of daughterboard 14. Internal stabilizing beam 34 and external stabilizing beams 36 and 38 are designed to limit vibration of daughterboards relative to socket 10 to stabilize the daughterboard 14 within socket 10.

Movement of daughterboard 14 relative to socket 10 can intermittently or permanently interrupt the electronic signals between daughterboard 14 and motherboard 12. As the size of computers becomes smaller, computers become more portable and movable. In addition, smaller computers are more easily shipped from place to place. During shipment, the computers are often subjected to rough handling. Movement of the computers increases the likelihood that shock and vibration will be applied to the computer. Therefore, the electrical connection between daughterboard 14 and motherboard 12 is likely to be subjected to an increased amount of shock and vibration. The retention force exerted by conventional stabilizing beams such as internal stabilizing beam 34 and external stabilizing beams 36 and 38 may not be sufficient to retain daughterboard 14 within socket 10 to maintain the electrical connection between daughterboard 14 and motherboard 12 in stressful environments.

The retention force exerted by contact surfaces 40 and 42 of internal stabilizing beam 34 and contact surfaces 44 and 46 of external stabilizing beams 36 and 38 are frictional forces only. While such retention force is suitable for rather stable environments, the retention force may be insufficient if the computer in which SIMM socket 10 is installed is subjected to shock and vibration in stressful environments such as when the computer is moved frequently.

Therefore, a retainer clip 60 of the present invention is inserted adjacent each of the external stabilizing beams 36 and 38 to provide an additional retention force to retain daughterboard 14 in socket 10. Retainer clips 60 are located adjacent elongated slots 26 and 28 so that head portions 62 of retainer clips 60 extend into the slots 26 and 28 and enter apertures 22 of daughterboards 14 as discussed below to retain the daughterboards 14 within socket 10.

Figure 2:
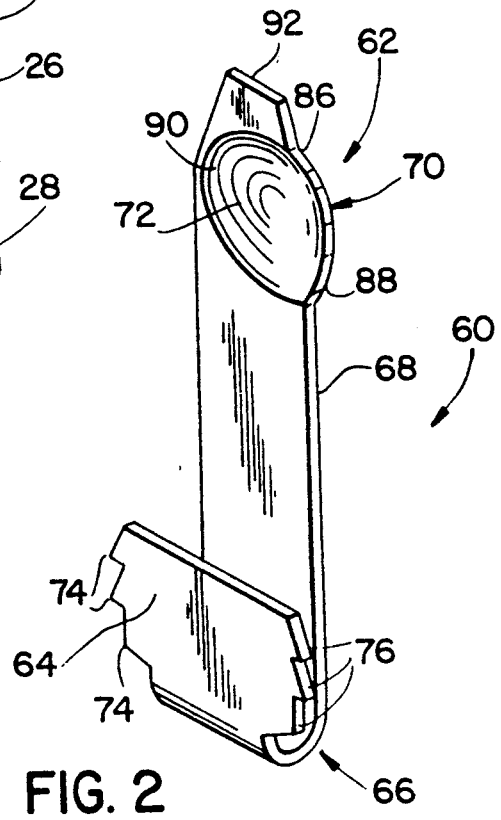
FIG. 2 is a perspective view of the retainer clip of the present invention.

Retainer clip 60 is illustrated in detail in FIG. 2. Retainer clip 60 includes a retention section 64, a generally U-shaped base section 66, and a spring section or member 68 extending upwardly from base section 66. Head portion 62 is formed on a distal end of spring member 68. Head portion 62 includes a convex contoured section 70 and a rear concave surface 72. Contoured section 70 is formed eccentrically with spring member 68. Retention barbs 74 are formed on a first side of retention section 64 and retention barbs 76 are formed on a second side of retention section 64. Barbs 74 and 76 are configured to engage a portion of the plastic housing 30 of SIMM socket to retain retainer clip 60 within socket 10.

Figure 3:
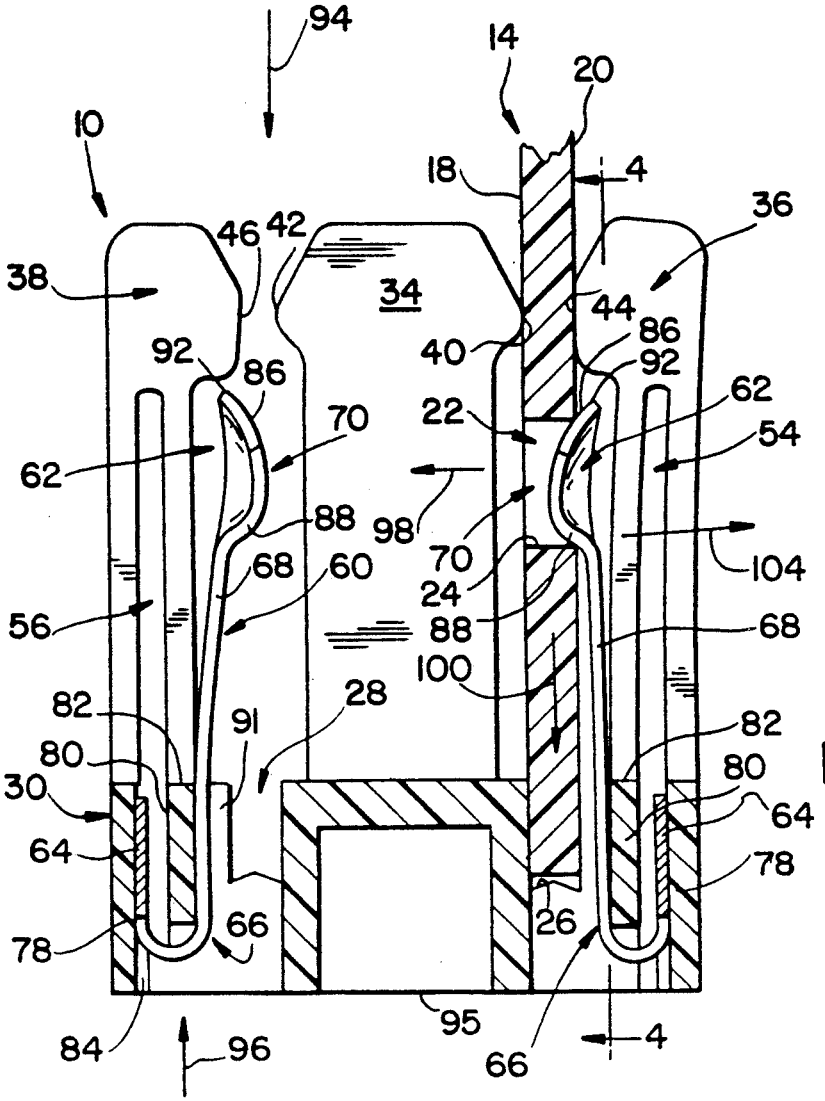
FIG. 3 is a sectional view taken along lines 3—3 of FIG. 1 illustrating the configuration of the daughterboard inserted into one of the elongated slots of the socket.
Figure 5:
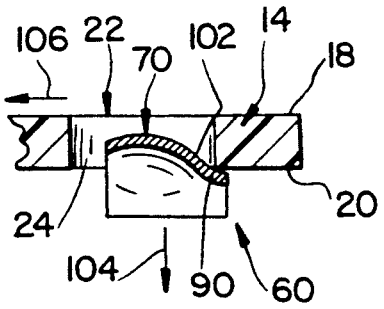
FIG. 5 is a sectional view taken along lines 5—5 of FIG. 4, further illustrating the configuration of a head portion of the retainer clip and the position of the retainer clip relative to the aperture formed in the daughterboard.

FIG. 3 illustrates the configuration of retainer clip 60 located within end portion 32 of SIMM socket 10 with daughterboard 14 installed into elongated slot 26. Housing 30 of socket 10 includes an outer wall 78 and an inner support wall 80. Spring member 68 of retainer clip 60 begins at a top edge 82 of inner wall 80. The base section 66 which engages wall 80 does not move. Retention section 64 is located in a T-shaped slot 84 formed in housing 30 so that barbs 74 and 76 engage a portion of housing 30 to retain retainer clip 60 within socket 10. Contoured portion 70 of head portion 62 includes a top surface 86, a bottom surface 88, and a side surface 90. Side surface 90 is best illustrated in FIG. 5.

Before daughterboard 14 is inserted, head portion 62 of retainer clip 60 extends into a plane defined by an edge 91 of slots 26 or 28. Top edges 92 of retainer clips 60 are located behind a plane defined by contact portions 44 and 46 of stabilizing beams 36 and 38, respectively. This prevents stubbing of daughterboard 14 against top edge 92 of spring clip 60 as daughterboard 14 is inserted into elongated slot 26 or 28. Therefore, retainer clip 60 is substantially hidden to an end user looking downwardly on SIMM socket 10 in the direction of arrow 94. Retainer clip 60 functions to retain daughterboard 14 within socket 10 without the requirement that the retainer clip 60 is directly displaced by the end user. This provides an advantage over conventional latches which require an end user to displace the latch before a daughterboard can be released from the socket.

Retainer clips 60 are designed to be loaded into SIMM socket 10 along a bottom surface 95 of housing 30 in the direction of arrow 96. Therefore, retainer clip 60 is not exposed at daughterboard 14 entry location. This prevents the possibility of destruction of retainer clips 60 when daughterboard 14 is inserted into elongated slots 26 or 28.

Retention section 64 provides a positive lock for retainer clip 60 in housing 30 by double-opposing sets of barbs 74 and 76. Because of the U-shaped base section 66, retention section 64 is bent at a 180° angle relative spring member 68. This prevents retainer clip 60 from being pushed out through bottom surface 95 of housing 30 as daughterboard 14 is inserted into elongated slot 26 or 28. In addition, the configuration of retainer clip 60 provides resiliency. Retainer clip 60 also permits a forward displacement in the case of daughterboard jamming which in turn prevents a fatigue of spring section 68.

Figure 4:
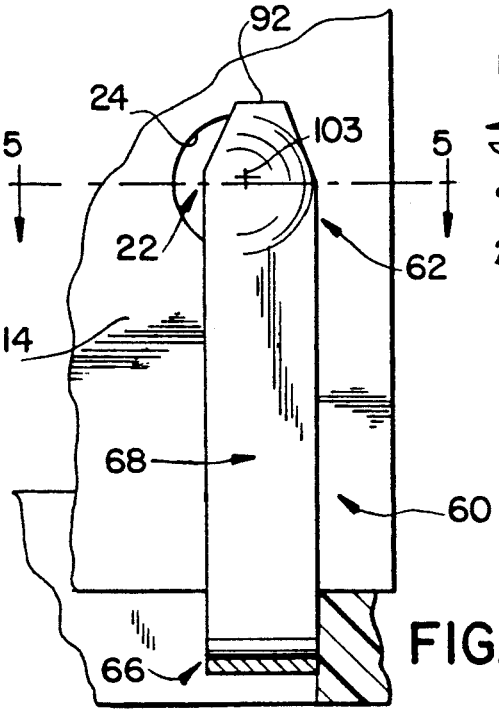
FIG. 4 is a sectional view taken along lines 4—4 of FIG. 3 illustrating the retainer clip as it engages an aperture formed in the daughterboard.

As illustrated in FIGS. 3-5, head portion 62 is deflected in the direction of arrow 104 as daughterboard 14 is inserted into slot 26. Head portion 62 enters aperture 22 formed in daughterboard 14 after daughterboard 14 is fully inserted into elongated slot 26. The configuration of contoured portion is designed so that top surface 86 and bottom surface 88 always make contact with top and bottom edges of interior wall 24 which defines aperture 22.

Top surface 86 is configured to provide a lateral, horizontally directed force substantially parallel to motherboard 12 against daughterboard 14 in the direction of arrow 98. This provides an additional force to hold daughterboard 14 against contact surface 40 of internal stabilizing beam 34. Therefore, retainer clip 60 increases the frictional force of contact surface 40 of internal stabilizing beam 34 against daughterboard 14 to increase the retention force on daughterboard 14. In addition, top surface 86 provides a gentle lead-in angle so that retainer clip 60 does not substantially increase the insertion force required to insert the daughterboard 14 into socket 10.

Bottom surface 88 of contoured portion 70 is aligned at a relatively steep angle relative to spring member 68. Bottom surface 88 enters aperture 22 and engages a bottom portion of inner side wall 62 to provide a positive retention lock. However, bottom surface 88 permits retainer clip 60 to release daughterboard 14 when a large enough force is exerted on daughterboard 14. Therefore, a user does not need to physically displace or disengage head portion 62 of retainer clip 60 from aperture 22 in order to release daughterboard 14 from socket 10. A contoured portion 70 is configured so that no matter how deep the contoured portion 70 enters into aperture 22, the locking angle of bottom surface 88 remains substantially constant.

Contoured section 70 is eccentric with spring member 68. In other words, a center 103 of contoured section 70 is formed slightly spaced apart from a center of spring member 68. Because of the eccentric formation of contoured section 70, side surface 90 is formed on spring member 68. Side surface 90 does not enter aperture 22. Side surface 90 engages a side surface 20 of daughterboard 14. Side surface 90 facilitates removal of daughterboard 14 from socket 10. Side surface 90 of contoured section 70 includes a gentle curved ramp 102 which engages a portion of interior wall 24 as daughterboard 14 is being removed. As daughterboard 14 is rotated out of slot 26, daughterboard moves in the direction of arrow 106 in FIG. 5. Movement of daughterboard 14 in the direction of arrow 106 exerts a force on retainer clip 60 to move head portion 62 of retainer clip 60 in the direction of arrow 104 in FIGS. 3 and 5. Therefore, head portion 62 moves out of aperture 22 to permit withdrawal of daughterboard 14 from socket 10. Side surface 90 provides a gentle ramp 102 which reduces the likelihood of catching or scraping daughterboard 14 during removal of daughterboard 14 from socket 10.

Retainer clip 60 is designed to increase assurance and retention of daughterboard 14 within the socket 10 during movement, vibration or shock of socket 10 which can occur under rigid mechanical conditions. Retainer clip 60 increases a horizontal frictional retention force applied to daughterboard 14 by an internal stabilizing beam 34. This is because top surface 86 applies a normal force against daughterboard 14 in the direction of arrow 98. In addition, retainer clip 60 provides a downwardly-directed vertical retention force to daughterboard 14 in a direction substantially 90° to motherboard 12 as illustrated by arrow 100. This additional retention force is accomplished without the use of a latch which the user must manually displace in order to remove the daughterboard 14 from socket 10. A computer in which socket 10 is installed can be subjected to an increased amount of shock and vibration due to movement of the computer without dislocating daughterboard 14 from socket 10. Therefore, retainer clip 60 reduces the likelihood of intermittent or failed signal paths from daughterboard 14 to motherboard 12.

Retainer clip 60 advantageously provides improved locking and stabilization of daughterboard 14 and reduces the likelihood that daughterboard 14 will walk out or dislodge from socket 10. Therefore, retainer clip 60 reduces the likelihood that a computer using socket 10 will fail due to mechanical shock or vibration. The contoured section 70 of retainer clip 60 is configured to allow for locational and size tolerances of the aperture 22 formed in daughterboard 14.

The retainer clip 60 of the present invention is preferably used in a SIMM socket 10 which includes an ejector for ejecting daughterboards 14 from the elongated slots 26 and 28. Preferably, a dual module ejector illustrated in U.S. patent application Ser. No. 07/725,581 which is assigned to the assignee of the present invention is used to eject daughterboards 14 from socket 10.

It is understood that a retainer clip 60 is located adjacent each end of both of the elongated slots 26 and 28. In other words, four retainer clips 60 are typically used with each socket 10. The retainer clips 60 located at opposite ends of slots 26 and 28 are not identical. As illustrated in FIGS. 1 and 3, the retainer clips 60 located at opposite ends of slots 26 and 28 are mirror symmetrical.

Although the preferred embodiment of the present invention illustrates retainer clips 60 adjacent the external stabilizing beams 36 and 38, it is possible that the retainer clips 60 may be mounted on an opposite side of the elongated slots 26 and 28 directly adjacent the internal stabilizing beam 34. It is also understood that the retainer clip 60 of the present invention may be used in other sockets in addition to the SIMM socket 10 illustrated in FIGS. 1 and 3. For instance, retainer clip 60 can be used with a socket which includes only one module-receiving elongated slot.

Retainer clip 60 is preferably made from a metal material. Retainer clip 60 is preferably stamped formed in a progressive die system in a conventional manner.

Although the invention has been described in detail with reference to a certain preferred embodiment, variations and modifications exist within the scope and spirit of the invention as described and defined in the following claims.

What is claimed is:

1. A retainer clip for securing a printed circuit board to a socket having an elongated slot for receiving the board therein, the retainer clip comprising:

a retention section for engaging the socket to retain the retainer clip within the socket;

a spring section extending upwardly away from the retention section and having an upper distal end, the spring section extending into a plane defined by an edge of the elongated slot; and a contoured section formed at the distal end of the spring section, the contoured section including a top surface for applying a force against the board in a direction normal to the board to hold the board against the socket, thereby stabilizing the board in the socket, the contoured section also including a bottom surface for applying a downwardly directed force on the board into said elongated slot.

2. The retainer clip of claim 1, wherein the contoured section further includes a side surface for engaging the board, the side surface providing a ramp for moving the distal end of the spring section relative to the board to disengage the contoured section from the aperture of the board to permit removal of the board from the socket.

3. The retainer clip of claim 1, further comprising a pair of opposing barbs coupled to the retention section of the retainer clip to secure the retainer clip within the socket.

4. The retainer clip of claim 1, further comprising a generally U-shaped base located between the retention section and the spring section.

5. The retainer clip of claim 1, wherein the retainer clip is inserted into the socket from a bottom surface of the socket.

6. The retainer clip of claim 1, wherein the socket is formed to include a generally T-shaped slot for receiving the retention section of the retainer clip therein to secure the retainer clip to the socket.

7. The retainer clip of claim 1, wherein the contoured section is formed eccentrically with the distal end of the spring section.

8. The retainer clip of claim 1, wherein the socket includes an internal stabilizing beam and an external stabilizing beam for engaging opposite sides of the board to stabilize the board relative to the socket, the retainer clip being located adjacent the internal and external stabilizing beams to enter said aperture in the board and to increase the retention force on the board relative to the socket.

9. The retainer clip of claim 8, wherein the external stabilizing beam includes a contact section for engaging a side of the board to stabilize the board relative to the socket, and the retainer clip is substantially hidden beneath the contact section of the external stabilizing beam.

10. A connector for electrically coupling a printed circuit board formed to include an aperture therein to the connector, the connector comprising:

a socket including an elongated slot for receiving the board therein and a plurality of longitudinally spaced electrical contacts to be coupled to the board located adjacent the elongated slot;

an internal stabilizing beam formed on an end for the socket on a first side of the elongated slot, the internal stabilizing beam including a contact surface for engaging a first side of the board;

an external stabilizing beam formed on the end of the socket on a second and opposite side of the elongated slot, the external stabilizing beam including a contact surface for engaging a second and opposite side of the board to stabilize the board relative to the socket; and a retainer clip coupled to the socket adjacent the internal and external stabilizing beams, the retainer clip including means for engaging the socket to retain the retainer clip within the socket and a head portion configured to enter said aperture in the board to apply a force on the board, thereby increasing the retention force on the board within the socket.

11. The connector of claim 10, wherein the retainer clip is substantially concealed beneath the contact surface of the external stabilizing beam.

12. The connector of claim 10, wherein the retainer clip includes a spring section extending upwardly away from the means for engaging the socket, and the head portion is formed on a distal end of the spring section.

13. The connector of claim 12, wherein the spring section extends into a plane defined by an edge of the elongated slot to apply a spring force to the board in a direction normal to the board upon insertion of the board into the elongated slot.

14. The connector of claim 10, wherein the head portion of the retainer clip includes a contoured section configured to engage the aperture formed in the board to retain the board within the socket, the contoured section including a top surface for applying a force against the board in a direction normal to the board and including a bottom surface for applying a downwardly-directed force against the board to retain the board in the elongated slot.

15. The connector of claim 14, wherein the contoured section further includes a side surface for engaging the board, the side surface providing a ramp surface for moving a distal end of the retainer clip relative to the board so that the head portion disengages the aperture to permit removal of the board from the socket.

16. The connector of claim 14, wherein the contoured section is formed eccentrically with a distal end of the retainer clip.

17. The connector of claim 10, wherein the means for engaging the socket to retain the retainer clip within the socket includes a retention section and a pair of opposing barbs formed on the retention section for engaging the socket to secure the retainer clip within the socket.

18. The connector of claim 17, further comprising a generally U-shaped base formed between the retention section and the head portion of the retainer clip.

19. The connector of claim 10, wherein the retainer clip is inserted from beneath the socket into a slot formed in a bottom surface of the socket.

20. The connector of claim 19, wherein the slot formed in the bottom surface of the socket for receiving the retainer clip therein is generally T-shaped.

21. A connector for electrically coupling a printed circuit board formed to include an aperture therein to the connector, the connector comprising:

a socket including an elongated slot for receiving the board therein and a plurality of longitudinally spaced electrical contacts to be coupled to the board located adjacent the elongated slot;

means for stabilizing the board in the socket, the stabilizing means engaging the board to limit vibration of the board relative to the socket; and means for retaining the board within the socket, the retaining means including means for engaging the socket to hold the retaining means within the socket and means for engaging the board to apply a downwardly directed force on the board into the elongated slot, thereby increasing the retention force on the board within the socket.

22. The connector of claim 21, wherein the stabilizing means includes an internal stabilizing beam formed on an end for the socket on a first side of the elongated slot, the internal stabilizing beam including a contact surface for engaging a first side of the board, and an external stabilizing beam formed on the end of the socket on a second and opposite side of the elongated slot, the external stabilizing beam including a contact surface for engaging a second and opposite side of the board to stabilize the board relative to the socket.

23. The connector of claim 21, wherein the means for engaging the socket includes a retention section and a pair of opposing barbs formed on the retention section for engaging the socket to secure the retaining means within the socket.

24. The connector of claim 21, wherein the retaining means increases a frictional force applied by the stabilizing means to the board and the retaining means also applies a downwardly-directed vertical force on the board.

25. The connector of claim 21, wherein the retaining means includes a retainer clip having a spring section extending upwardly away from the means for engaging the socket and a head portion formed on a distal end of the spring section for engaging the board to increase the retention force on the board within the socket.

26. The connector of claim 25, wherein the spring section extends into a plane defined by an edge of the elongated slot to apply a spring force to the board in a direction normal to the board upon insertion of the board into the elongated slot.

27. A retainer clip for securing a printed circuit board to a socket having an elongated slot for receiving the board therein, the retainer clip comprising:

a retention section for engaging the socket to retain the retainer clip within the socket;

a spring section extending upwardly away from the retention section and having an upper distal end, the spring section extending into a plane defined by an edge of the elongated slot; and a contoured section formed at the distal end of the spring section, the contoured section being configured to engage an aperture formed in the board to retain the board within the socket, the contoured section being configured to define a side surface for engaging the board, the side surface extending out of the aperture to provide a ramp for moving the distal end of the spring section relative to the board to disengage the contoured section from the aperture of the board upon rotation of the board relative to the retainer clip to permit removal of the board from the socket.

28. The retainer clip of claim 27, wherein the contoured section includes a top surface for applying a force against the board in a direction normal to the board and a bottom surface for applying a force against the board in a direction downwardly into said elongated slot.

29. The retainer clip of claim 27, further comprising a pair of opposing barbs coupled to the retention section of the retainer clip to secure the retainer clip within the socket.

30. The retainer clip of claim 27, wherein the socket includes an internal stabilizing beam and an external stabilizing beam for engaging opposite sides of the board to stabilize the board relative to the socket, the retainer clip being located adjacent the internal and external stabilizing beams to enter said aperture in the board and to increase the retention force on the board relative to the socket.

31. The retainer clip of claim 30, wherein the external stabilizing beam includes a contact section for engaging a side of the board to stabilize the board relative to the socket, and the retainer clip is substantially hidden beneath the contact section of the external stabilizing beam.

32. The retainer clip of claim 30, wherein the contoured section is formed eccentrically with the spring section.

* * * * *